United States Patent [19]

Johnston et al.

[11] Patent Number: 4,766,745

[45] Date of Patent: Aug. 30, 1988

[54] APPARATUS FOR PRINTING CARPET TILES

[75] Inventors: Jerry H. Johnston; Charles F. Lowery, both of Summerville, Ga.

[73] Assignee: Bigelow-Sanford, Inc., Greenville, S.C.

[21] Appl. No.: 828,627

[22] Filed: Feb. 10, 1986

[51] Int. Cl.[4] ..... D06B 1/10; D06B 11/00; B41F 17/00

[52] U.S. Cl. ..... 68/200; 101/35; 101/150; 198/409; 198/471.1; 414/225

[58] Field of Search ..... 8/148, 150; 68/200; 101/35, 115, 126, 150; 198/409, 471.1, 803.5; 414/225, 744 B

[56] References Cited

U.S. PATENT DOCUMENTS

| | | | |
|---|---|---|---|
| 1,461,222 | 7/1923 | Myers | 198/471.1 |
| 2,816,811 | 12/1957 | Tillett et al. | 8/148 |
| 2,984,540 | 5/1961 | Tillett et al. | 8/148 |
| 3,175,488 | 3/1965 | Tillett et al. | 101/115 |
| 3,185,084 | 5/1965 | Short et al. | 101/115 |
| 3,276,356 | 10/1966 | Usko et al. | 101/115 X |
| 3,416,440 | 12/1968 | Miller et al. | 101/35 |
| 3,419,413 | 12/1968 | Euforbia | 101/115 X |
| 3,459,125 | 8/1969 | Forslund | 101/35 |
| 3,525,303 | 8/1970 | Cummings | 101/35 |
| 3,543,679 | 12/1970 | Wahl | 101/35 |
| 3,616,942 | 11/1971 | Gruber | 198/471.1 X |
| 3,719,141 | 3/1973 | Jaffa et al. | 101/126 |
| 3,763,776 | 10/1973 | Jaffa | 101/126 |
| 4,010,709 | 3/1977 | Sayman et al. | 68/205 R X |
| 4,031,280 | 6/1977 | Weller et al. | 8/148 X |
| 4,165,547 | 8/1979 | Parlin et al. | 8/148 |
| 4,336,753 | 6/1982 | Vidalis | 101/127 |
| 4,583,458 | 4/1986 | Beachum | 101/115 X |

FOREIGN PATENT DOCUMENTS

| | | |
|---|---|---|
| 955545 | 4/1964 | United Kingdom . |
| 1358033 | 6/1974 | United Kingdom . |

*Primary Examiner*—Philip R. Coe

*Attorney, Agent, or Firm*—Bell, Seltzer, Park & Gibson

[57] ABSTRACT

An apparatus for accurate, precise and successive registration, indexing and printing of individual pre-cut backed carpet tiles. The apparatus comprises a central control and transport mechanism; a plurality of tile processing stations adjacent one another and surrounding the central control and transport mechanism; and a plurality of tile carriers movably and sequentially carried by the central control mechanism for sequentially carrying individual carpet tiles to one or more of the processing stations. The processing stations comprise a tile registration station, a printing station and a tile unloading station. The apparatus also includes a steamer for fixing printed colorant on carpet tiles, a vacuum device for removing excess moisture from carpet tiles and a dryer for drying the carpet tiles.

15 Claims, 7 Drawing Sheets

54
56
55
57
61
62

40
53
20
30
50
10
42
77
82
73
81

75
10
80
92
91
90
82
103a
13
12
85
VACUUM SOURCE
95
60
13
103b

APPARATUS FOR PRINTING CARPET TILES

FIELD OF THE INVENTION

The present invention relates to the printing of one or more colors on individual, pre-cut backed carpet tiles and is related to current copending U.S. patent application Ser. No. 738,168 filed May 24, 1985 for "Method of Printing Carpet Tiles."

BACKGROUND OF THE INVENTION

One of the more popular developments in floor coverings in recent years is the individual pre-cut backed carpet tile, usually of a size comparable to more traditional types of tile such as linoleum. Carpet tiles provide flexibility in designing and obtaining floor coverings where the performance and appearance of carpet are desired, but where traditional roll or area carpeting may not be appropriate because of costs, flexibility, area geometry or other factors.

Prior to the development of tiles having the various characteristics desirably found in carpeting such as durability and appearance, carpeting choices were generally limited to area rugs or wall-to-wall carpeting formed from single pieces or rolls of carpet. Area rugs are of certain definite sizes and consequently may only be used in certain types of areas. Similarly, regular roll or wall-to-wall type carpeting must be customized to fit the areas in which it is to be used. In contrast, the carpet tile provides a more efficient method of obtaining carpeting both on areas which are traditionally difficult to carpet and on those which have traditionally been carpeted with area rugs or wall-to-wall carpets. Carpet tiles can be easily laid individually in column by row arrays, and only the carpet tiles which border the edges of the area to be carpeted need be customized. Either wall-to-wall or definite areas of carpeting may be accomplished. Similarly, replacement of worn and damaged tiles can be done in limited areas.

A desirable carpet tile will exhibit the necessary qualities with respect to both function and appearance which are desirably required of other types of carpeting.

A carpet tile generally comprises some sort of primary backing, to which the fibers, tufts or loops forming the carpet face are attached. Functionally, because individual carpet tiles are relatively small, e.g. 18"×18", they are also relatively light in weight and individually do not have the amount of inertial weight that an entire piece of area or wall-to-wall carpet would have, and which helps maintain the carpet in a flat orientation. Consequently, the carpet tile must have some additional backing characteristics enabling it to lay flat of its own accord, rather than as a result of being a small portion of a much larger heavier carpet held flat by its weight. Because of their small size and weight, most carpet tile is backed after weaving or tufting with an impermeable backing of resilient material, such as PVC, polyurethane or the like, which provides added stiffness and weight and which helps the carpet tile lay flat by itself.

Preferably, carpet tile is formed by dye-cutting smaller tile-size sections from previously woven, tufted or fiber bonded carpet. For example, tile may be formed by tufting yarns through a permeable primary backing to form a length or roll of carpet of a given width, e.g. 3, 9 or 12 feet. The surface of the primary backing opposite to the tufts forming the carpet face may then have a resilient material such as latex, polyvinyl chloride (PVC), foam, etc. coated thereon or otherwise applied thereto, after which the backed carpet fabric is cut into the desired dimensions for individual tiles.

For the sake of appearance, a carpet carrying one or more designs is often desirable. When area carpets or roll carpets are manufactured, they may be either woven with multiple colors of yarn, or printed or dyed after weaving to produce desired designs. In a similar manner, where carpeting is formed from carpet tiles, a design which may be either repetitive from tile to tile or which builds from tile to tile into a larger design is also sometimes desirable.

Certain difficulties arise, however, in the production of carpet tiles carrying designs. First, where patterned carpet tiles are cut from larger portions of patterned carpet, the cutting process can distort the pattern. In such cases, a desired pattern formed from the cut tiles cannot be reproduced from carpet to carpet and often the original pattern of the larger carpet from which the carpet tiles were cut cannot be accurately recreated. Moreover, where the pattern design repeat is larger than any individual tile, the distorted tiles make difficult, if not impossible, orientation of individual tiles to create or recreate the pattern.

There exist other problems in obtaining individual carpet tiles carrying precisely an accurately reproduced pattern. For example, one type of apparatus for printing carpet tiles to get good pattern repetition is the screen stencil. In such equipment, used to color many textile items, individual carpet tiles are moved past a screen stencil, often in the form of a roller. Colorant is applied through predetermined portions of the screen onto corresponding portions of the surface of the carpet tile. While good pattern repetition may be obtained by screen stenciling, those familiar with screen stenciling will be aware that this method generally provides only a surface coloring of deeper pile fabrics such as carpet tufts. When only the upper surfaces of the tufts of the carpet tiles are so colored, several problems arise. First, because of the lack of color in the lower portion ot the tufts, the surface colored tufts can give an unpleasant appearance when movement or traffic causes them to become moved. Second, such surface coloring will often wear faster than will the carpet itself, resulting in a shorter lifetime of the desired pattern.

In coloring portions of carpeting of larger, traditional sizes, certain equipment and methods have been proposed tor avoiding some of the limitations of screen stencil printing. In particular, a tuft dye mold has been used in coloring pile fabrics such as tufted carpets. A tuft dye mold generally comprises a horizontal mold of a size corresponding to the article of tufted fabric to be colored. A horizontal mold is divided in various sections corresponding to the pattern of color desired on the final object by a number of vertical walls within the horizontal mold. The various walls serve to separate sections of the mold from each other and to separate corresponding sections of the pile fabric from one another when brought into contact therewith. In printing a tufted fabric, the tufted fabric is either first brought into contact with the mold followed by the addition of fluid color into the individual sections, or colorant may be added first following which the tufted fabric is moved into engagement with the mold. In either case, the vertical divider walls between respective colorant-containing sections serve two purposes: they slip through the tufts of the fabric and provide definite lines of demarcation between respective portions of the tufted fabric, and they provide a barrier to the flow of colorant preventing it from migrating from one respective portion of the tufted fabric to another. Ideally, coloring using a tuft dye mold produces color along the entire length of the carpet tuft, resulting in a rich appearance in the pattern which will remain visible for the life of the carpet, regardless of wear.

Existing attempts at accomplishing such printing on large roll or piece carpeting include those described in U.S. Pat. Nos. 4,031,280; 3,175,488; 2,984,540 and 2,816,811.

With regard to individual, backed carpet tiles, however, problems arise in tuft dye mold printing which are not of concern printing larger pieces of carpet, but which have heretofore prevented its use on backed carpet tiles. Basically, as set forth earlier herein, larger pieces of carpet have primary backing of permeable material. When such a carpet is printed using a tuft dye mold, the woven backing provides a fluid-permeable surface through which any excess colorant may flow from any one or more of the respective portions of the tuft dye mold. Since at this stage the carpet has not yet received a resilient backing, excess colorant will flow through the primary backing rather than migrating into adjacent pattern areas. Because of this safety zone provided by the permeable backing, excess colorant is easily prevented from flowing into nondesignated areas and is thus prevented from spoiling the appearance of the pattern.

In coloring carpet tile, after it has been cut and backed, however, impermeable resilient backing eliminates any "safety zone" into which excess colorant can flow. Consequently, excess colorant tends to migrate between various sections of the carpet, even forcing its way past the vertical barriers in the tuft dye mold. This may result in a carpet tile with poor color resolution between adjacent colored areas and an undesirable final appearance, especially where large numbers of individual carpet tiles are placed together to form a floor covering.

Additionally, the types of tuft dye mold printing equipment developed for large carpets tend to be most suitable for low viscosity, highly fluid colorants. Although satisfactory enough for larger patterns on larger carpets, the placement of such colorants by such equipment cannot be controlled with the accuracy and precision required to produce a pattern on the much smaller scale of a carpet tile.

Finally, where the face portion of the carpet tile is of the "level loop" type, previous attempts to accomplish tuft dye mold printing have been unsuccessful on carpets of all sizes because the difficulty in controlling the flow of colorant on, around and through the loops.

In addition to the particular problems which arise in printing individual backed carpet tiles, further problems arise in finishing of such tiles. Broadly stated, finishing usually includes steps of fixing any colorant onto a printed carpet and drying, as the name implies, removes excess moisture from the carpet tile so that it can be packed, stored and shipped.

Because the backing of the carpet tile often comprises non-textile material of different chemical composition than the fibers, tufts or loops of the face, some of the processes for drying and finishing of ordinary carpet with ordinary backing will undesirably affect the impermeable plastic-type backing of most carpet tiles. In particular, the heat applied during the fixing and drying processes can potentially damage the backing of the carpet tile or causes it to curl and not lie flat.

Accordingly, the traditional methods of fixing and drying printed carpeting cannot be directly transferred to the manufacture of backed carpet tiles and any methods and equipment appropriate for finishing backed carpet tiles must address the particular characteristics presented by both the face and the backing of the carpet tile.

It is thus an object of the present invention to provide an apparatus for the accurate, precise and successive registration, indexing and printing of individual, pre-cut backed carpet tiles.

It is a further object of the invention to provide an apparatus for the accurate, precise and successive registration, indexing, printing and finishing of individual pre-cut backed carpet tiles.

It is a further object of the invention to provide an apparatus which can color individual carpet tiles both accurately and precisely so that any carpet pattern formed from these tiles will be of the desired final pattern regardless of the order in which the individual tiles were printed.

It is another object of the present invention to provide an apparatus for coloring individual pre-cut backed carpet tiles in a tuft dye mold while producing colorant penetration along the entire length of the tufts, whether cut pile or loops, along with high resolution and definition of colored portions of the carpet tile.

It is a further object of the invention to provide an apparatus for finishing carpet tiles which will effectively fix colorant upon the face of the carpet tile and remove undesirable amounts of moisture from a freshly printed carpet tile while concurrently avoiding potential damage to the backed portions of the individual carpet tiles.

SUMMARY OF THE INVENTION

The present invention provides an apparatus for accurate, precise and successive registration, indexing, printing and finishing of individual pre-cut backed carpet tiles. The apparatus comprises a central control and transport mechanism for controlling and accomplishing the movement, registration, indexing, printing and unloading of individual carpet tiles. A plurality of tile processing stations are positioned adjacent one another and surrounding the central control and transport mechanism, a first of which processing stations comprises a tile registration station, a second printing station and a third tile unloading station. A conveyor is provided, first portions of which are positioned at the unloading station for receiving thereon carpet tiles from the unloading station and second portions of which are positioned adjacent further processing equipment. The further processing equipment includes colorant fixing means having respective tile entry and tile exit positions and drying means adjacent the exit portions of the colorant fixing means for receiving and drying individual carpet tiles, each of which prevents undesirable treatment of the backed portions of the carpet tiles.

The foregoing and other objects, advantages and features of the invention, and the manner in which the same are accomplished will become more readily apparent upon consideration of the following detailed description of the invention taken in conjunction with the accompanying drawings, which illustrate preferred and exemplary embodiments, and wherein.

DETAILED DESCRIPTION OF THE INVENTION

Figure 3:
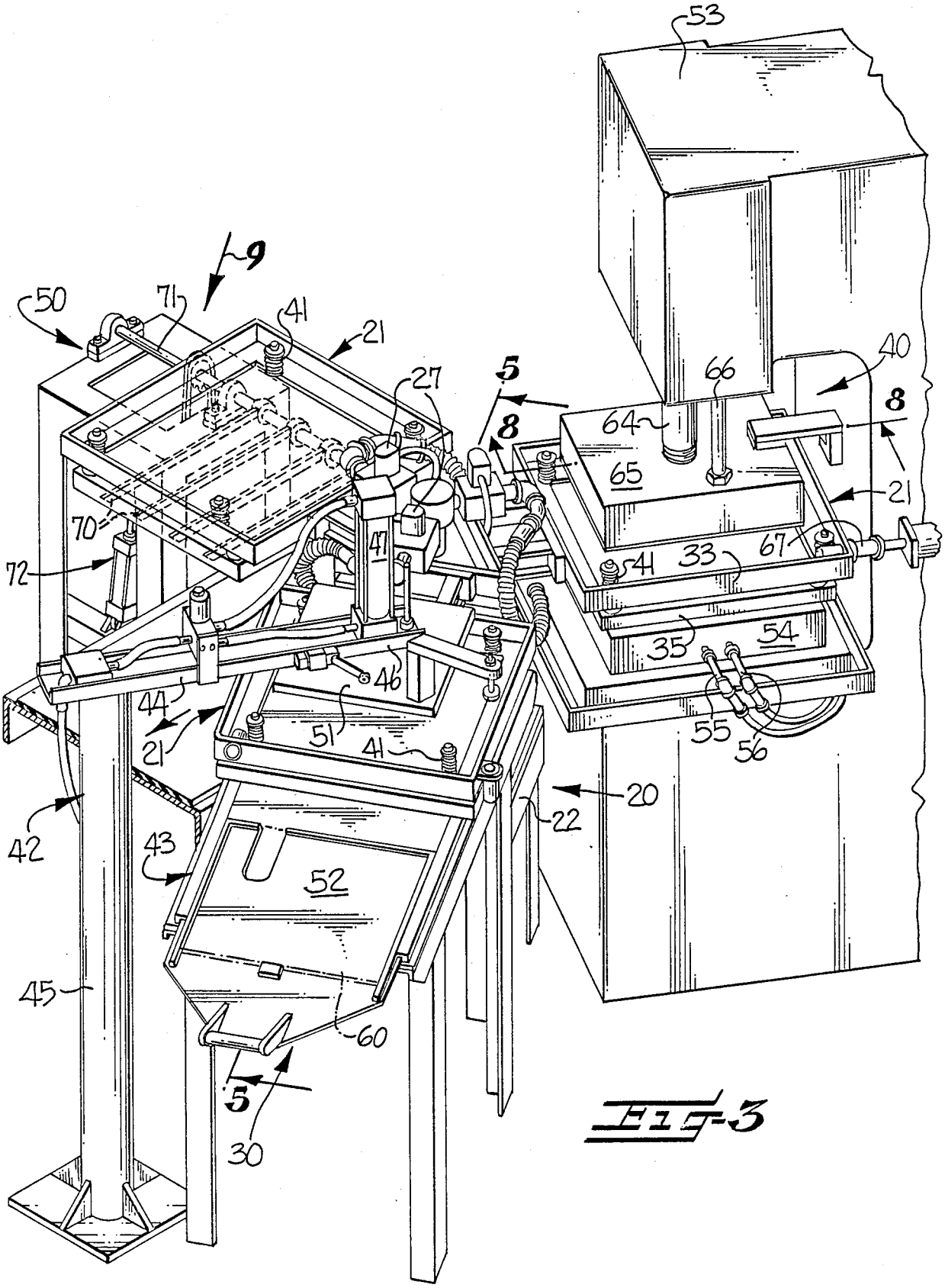
FIG. 3 is a more detailed perspective view of the registration, indexing, printing and unloading portions of the apparatus.
Figure 4:
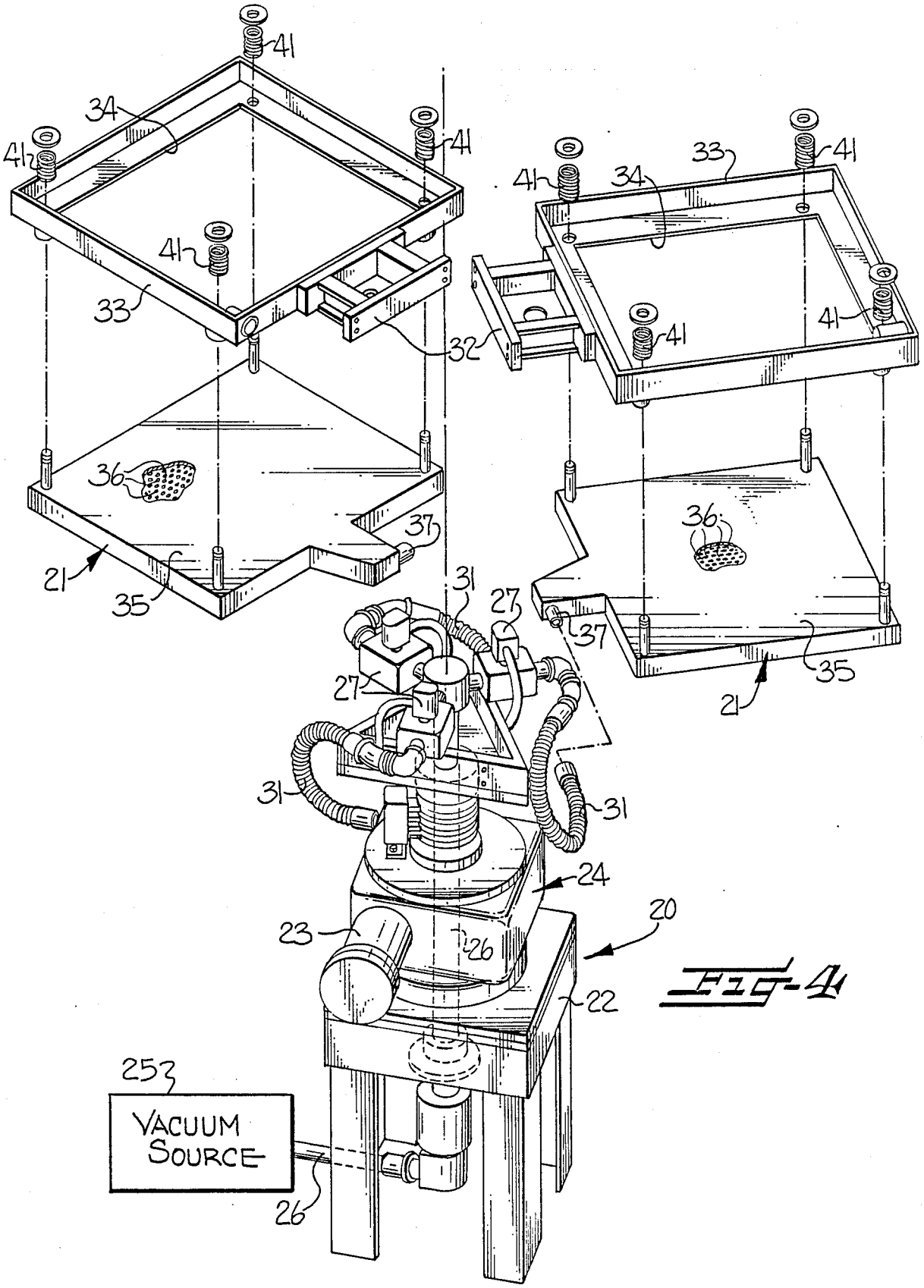
FIG. 4 is a perspective view of the central control and transport mechanism of the present invention and an exploded detail view of the tile carriers.

An overall view of a preferred embodiment of a main portion of the invention is illustrated in FIGS. 3 and 4. The invention includes a central control and transport mechanism broadly designated at 20 for controlling and accomplishing the sequential movement, registration, indexing, printing and unloading of individual carpet tiles. For purposes of clarity, FIG. 4 illustrates the central control and transport mechanism 20 in an isolated view apart from the plurality of tile processing stations which surround it.

FIG. 3 is a view of a preferred embodiment of the central control and transport mechanism 20 surrounded by three tile processing stations which respectively comprise a tile registration station broadly designated at 30, a tile printing station broadly designated at 40, and a tile unloading and orientation station broadly designated at 50.

A plurality ot tile carriers, each broadly designated as 21 are movably carried by the central control and transport mechanism 20 and are sequentially movable to each of the respective processing stations for sequentially carrying individual carpet tiles to one or more of the processing stations.

As illustrated by the arrangement shown in FIG. 3 and the isolated view of FIG. 4, the central control and transport mechanism 20 comprises a motorized turreting mechanism 24 having a plurality of arms thereon for bearing the tile carriers 21 and for movably and sequentially presenting each of the tile carriers to each of the processing stations. In the exploded view of FIG. 4, the arms are designated at 32 and are shown adjacent the tile carriers 21.

The turreting mechanism 24 is adapted to carry three tile carriers 21, two of which are illustrated in perspective exploded views. The turreting mechanism 24 is mounted on a base 22 and is pivoted by a motor 23 positioned on a gear reduction unit. The base 22 further carries the appropriate plumbing to supply vacuum and vacuum control to the central control and transport mechanism 20. The use of the vacuum and vacuum controls will be discussed in more detail later herein. In addition to the vacuum source 25, vacuum piping 26 carries the vacuum to the vacuum controls each of which has been designated 27. From the vacuum control 27, vacuum hoses 31 run to the tile carriers 21.

As seen in more detail in the exploded views of FIG. 4, each of the respective tile carriers 21 comprises a platen support maintained upon the arms 32. In the illustrated embodiment of the invention, the platen support comprises a generally rectangular frame portion 33 carried in a substantially horizontal orientation by one of the arms 32. The frame 33 has horizontally oriented centralized opening 34 therethrough for allowing independent mechanical access to the vacuum platen carried by the frame 33.

A vacuum platen 35 is positioned immediately beneath the platen support and serves to provide a vacuum pull against individual carpet tiles which are to be carried by the tile carriers so that individual carpet tiles will be maintained in register upon the tile carrier while being sequentially carried to and positioned at each of the respective processing stations. As seen in FIG. 4, the vacuum platen 35 comprises a generally rectangular horizontally oriented chamber having a series of vacuum openings 36 along the bottom face thereof communicating with a hose connection 37. When attached to the hose connection 37, the vacuum hoses 31 supply a vacuum from the vacuum source 25 to the vacuum openings 36 in order to hold an individual carpet tile in register against the tile carrier 21.

A plurality of elastic members, shown in FIG. 4 as the springs 41, are positioned on the frame 33 at spaced apart locations adjacent the centralized opening 34. In the embodiment illustrated, the springs 41 are positioned near the corners of the frame 33. The springs 31 engage the frame 33 and the vacuum platen 35 against one another and maintain the vacuum platen 35 in a substantial horizontal orientation closely adjacent the frame 33 in the absence of other forces acting thereon. At the same time, the elastic nature of the springs allows the vacuum platen 35 to be shifted partially away from the frame 33 by the respective actions of portions of the registration station 30 and the printing station 40 as will be described in more detail later herein.

A preferred embodiment of the tile registration means of the present invention is best illustrated in FIGS. 3, 5, 6 and 7. FIG. 3 is the best overall view of the tile registration station 30 and illustrates the loading press broadly designated at 42 and the alignment assembly broadly designated at 43 positioned opposite to and cooperatively operable with the loading press 42 for loading and positioning individual carpet tiles adjacent the vacuum platen. FIG. 3 also illustrates the vacuum control means 27 described earlier which are operable in response to the central control mechanism 20 and concurrently with the press 42 and the loading assembly 43 for causing the vacuum platen 35 to engage and maintain individual carpet tiles thereupon.

Viewed in more detail, the loading press 42 further comprises a loading press support 44, first portions of which are positioned adjacent the tile registration station and second portions of which overlie the tile registration station. In the embodiment illustrated, the first portions comprise a stand 45 and a horizontal arm 46 such that the stand may be positioned adjacent the tile registration station while the arm 46 positioned upon the stand 45 may extend over and above the tile registration station.

A loading piston 47 is carried on the arm portion 46 of the loading press support 44. A pressure plate 51 is engaged beneath and obedient to the loading piston 47 and both the piston 47 and the plate 51 directly overlie the tile registration station 30. The loading piston 47 urges the pressure plate 51 against portions of one of the respective vacuum platens 35 carried by the particular tile carrier 21 which is positioned at the tile registration station. In this manner, the loading press 47 may urge the respective vacuum platen 35 against individual carpet tiles to be registered therewith.

Figure 5:
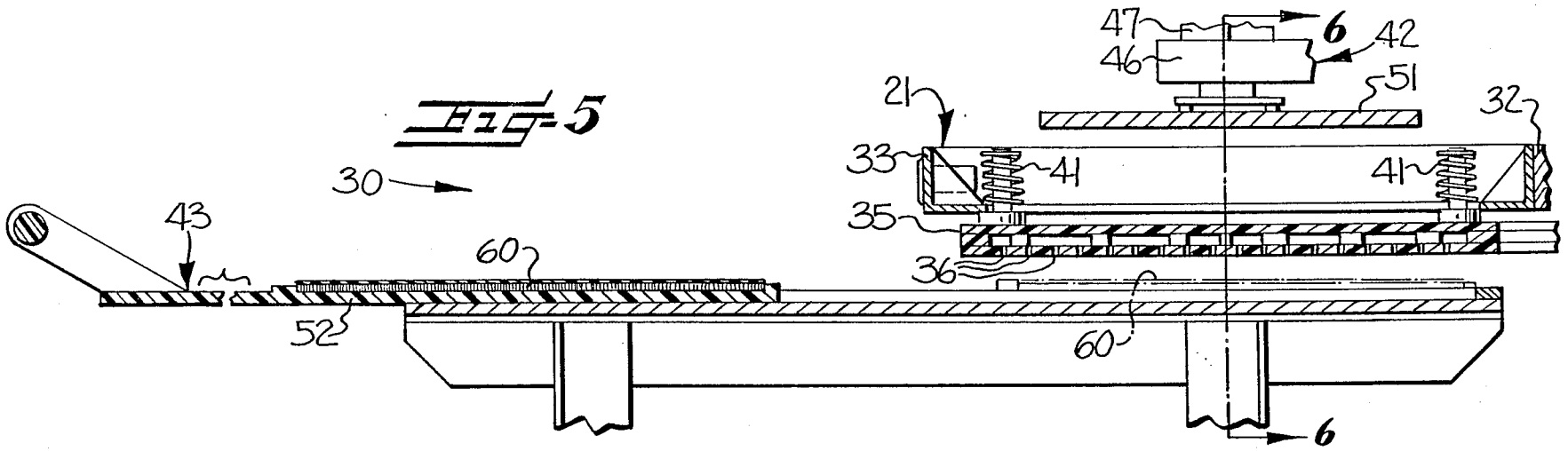
FIG. 5 is a longitudinal sectional view of the tile registration station taken along lines 5—5 of FIG. 3.
Figure 7:
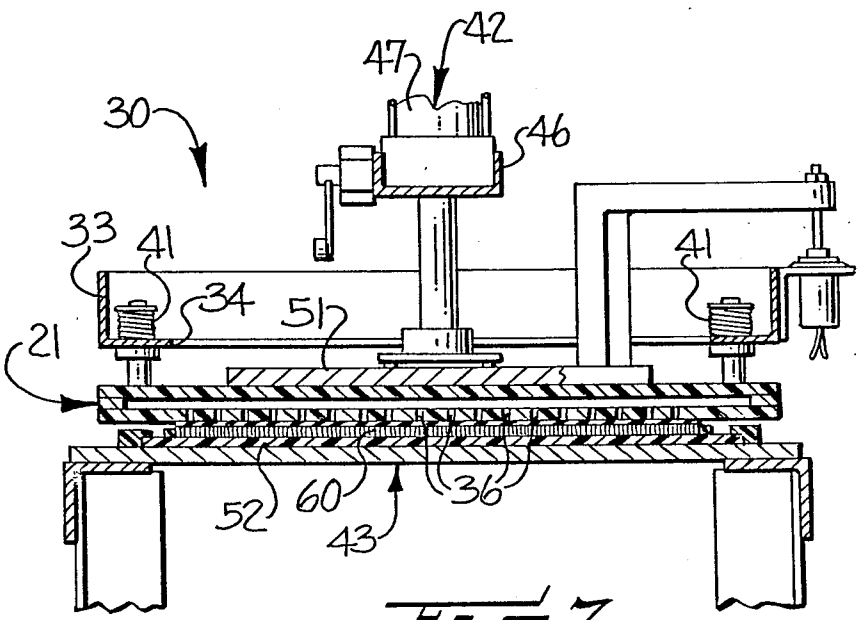
FIG. 7 is identical to FIG. 6, but showing the tile registration means in registration with the carpet tile.
Figure 6:
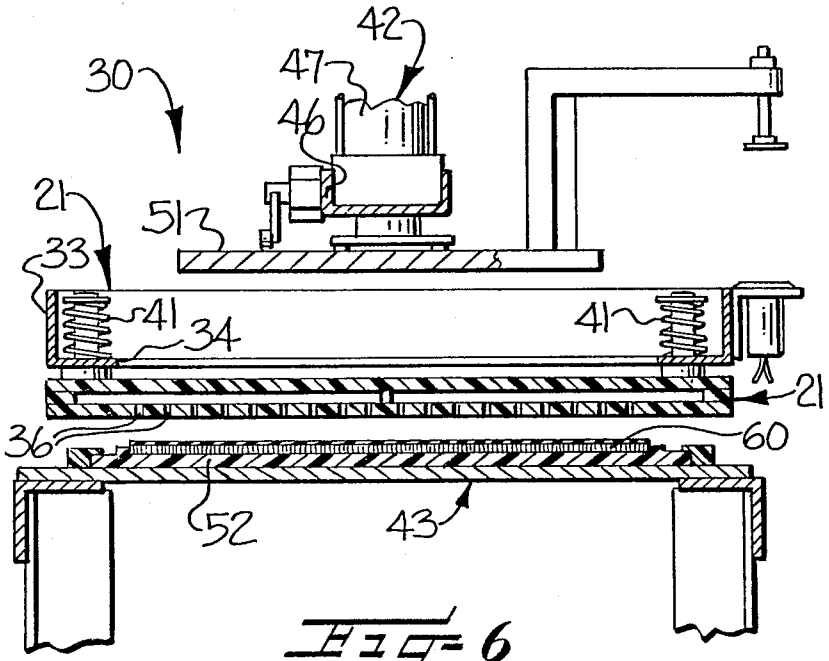
FIG. 6 is a transverse sectional view of the tile registration station taken along lines 6—6 of FIG. 5.

An additional part of the registration station is the alignment assembly 43. In the embodiment of the invention illustrated in FIGS. 3, 5, 6 and 7, the alignment assembly 43 comprises a tile alignment receptacle 52 slidably movable between respective first and second positions at the tile registration station 30. The first position is illustrated in FIGS. 3 and 5 and is laterally offset from the loading press 42. The second position is illustrated in FIGS. 6 and 7 and underlies the loading press 42. The movement between these two positions allows initial loading and aligning of an individual carpet tile on the receptacle 52 at the first position followed by movement of the receptacle 52 to the second position so that individual carpet tiles which are loaded and aligned on the receptacle 52 at the first position are appropriately aligned for registration with one of the tile carriers 21 when the receptacle 52 is moved to the second position.

FIGS. 5, 6 and 7 illustrates these features in more detail. FIG. 5 shows the tile alignment receptacle 52 in its first, laterally offset position and carrying an individual carpet tile designated at 60. A tile carrier 21 is positioned above the tile registration station with the springs 41 serving to maintain the vacuum platen 35 closely adjacent the frame 33 of the tile carrier 21.

FIG. 6 illustrates the relative positions of the components when the tile alignment receptacle 52 has been moved to the second position directly underneath the loading piston 47 and the pressure plate 51 of the loading press 42. In this position, the vacuum platen 35 is positioned directly above the individual carpet tile 60 which is to be registered.

FIG. 7 shows the position of the components upon action of the loading press 42. As illustrated, the loading piston 47 has moved the pressure plate 51 through the opening 34 in the frame 33 of the tile carrier 21. In doing so, the pressure plate 51 has urged the vacuum platen 35 away from the frame 33 while at the same time forcing the springs 41 into a compressed condition. In this position, the vacuum openings 36 in the vacuum platen 35 are in direct registration with the backing of the individual carpet tile 60, thereby allowing vacuum provided from the vacuum source 25 through the vacuum piping 26, controls 27, hoses 31 and platen 35 to be exerted against the individual carpet tile 60, to hold it in registration with the tile carrier 21. It will be seen from the relationships of the parts illustrated in FIGS. 6 and 7 that when the loading piston 47 is raised, the springs 41 will tend to return to their original configurations and thereby lift the vacuum platen 35, now carrying an individual carpet tile 60, back closely adjacent the frame 33.

Figure 8:
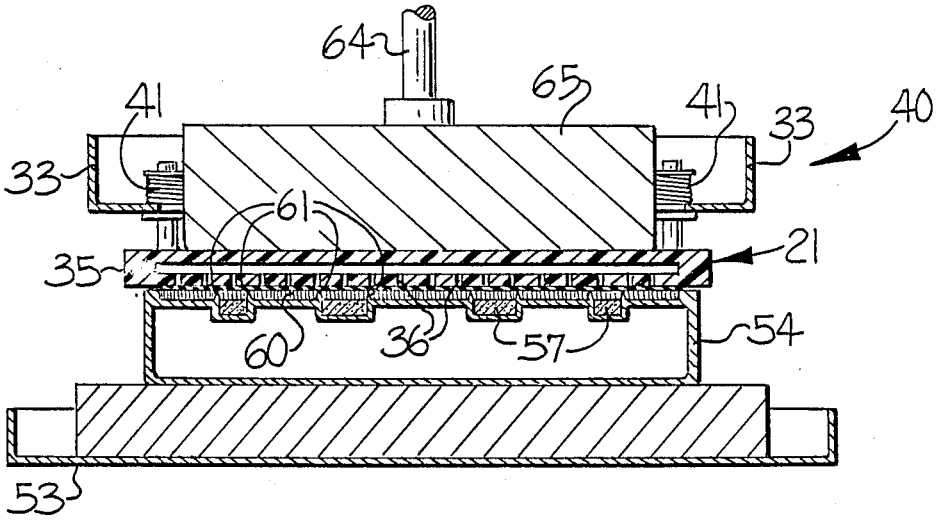
FIG. 8 is a transverse sectional view of the tile printing station taken along lines 8—8 of FIG. 3 and showing a backed carpet tile in registration with the tuft dye mold.

Once registered at the registration station 30, an individual carpet tile 60 is then moved on the tile carrier 21 to the printing station 40. The various aspects and components of this station are best illustrated in FIGS. 3 and 8. As shown in the perspective view of FIG. 3, the printing station comprises a carpet printing press 53 for causing pressure to be exerted on the backed portions of an individual carpet tile 60, a tuft dye mold 54 positioned opposite the printing press 53 and concurrently engageable with the face portions of individual carpet tiles 60, colorant supply means shown as the hoses and fittings 55 and 56, respectively, for supplying colorant to the tuft dye mold, and print regulating means for correlating the duration, pressure and amount of colorant supplied during the engagement of individual carpet tiles with the press 53 and the tuft dye mold 54.

Figures 1, 2, 2A:
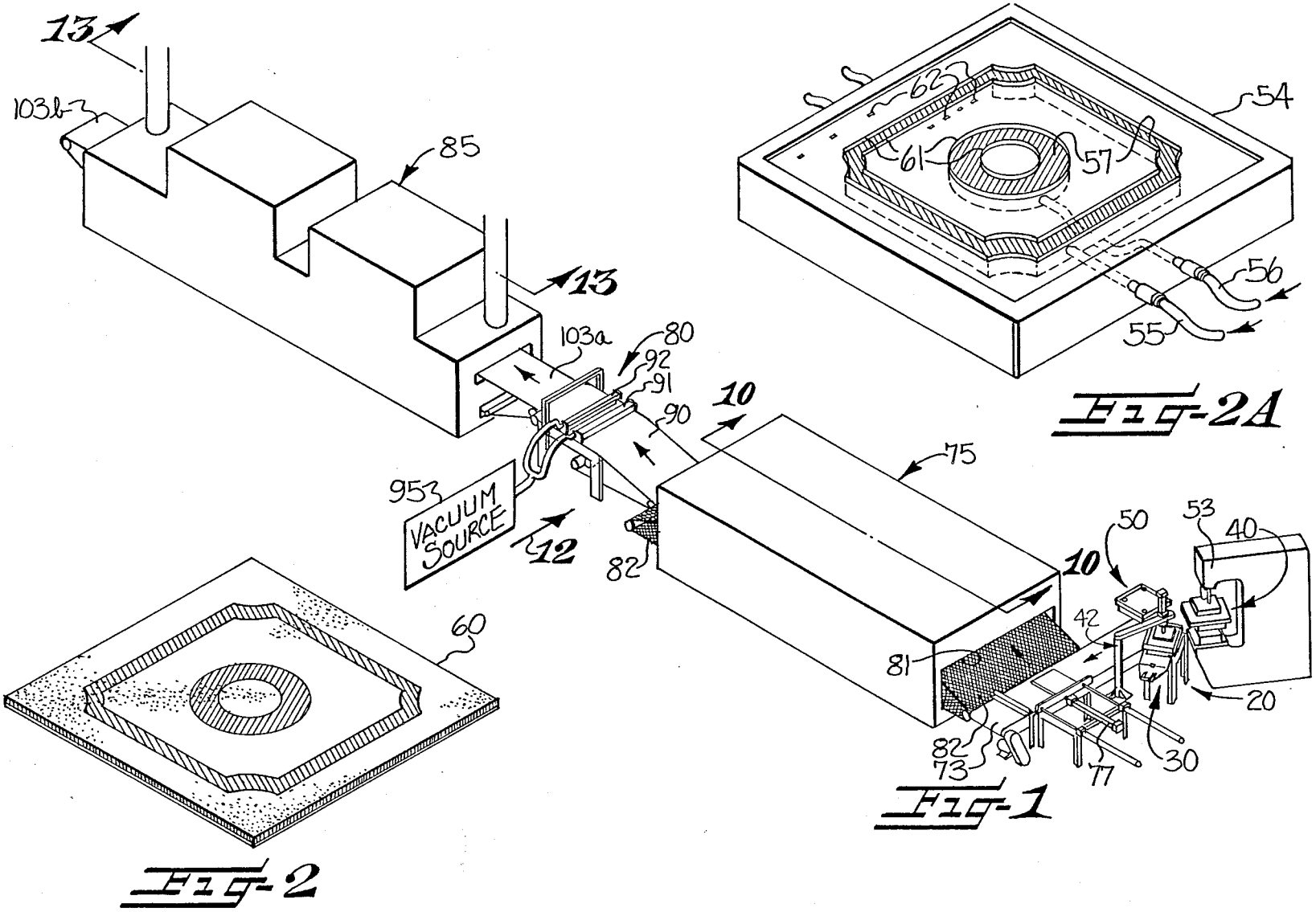
FIG. 1 is a perspective view of the tile printing and finishing apparatus.
FIG. 2 is a perspective view of a printed carpet tile.
FIG. 2A is a perspective view of a tuft dye mold which would produce the printed pattern of the tile seen in FIG. 2.

As seen in FIGS. 2 and 2A and in the cross sectional view of FIG. 8, the tuft dye mold 54 is of substantially the same shape and size as the individual carpet tiles 60 to be printed. Portions of the tuft dye mold include a plurality of dye mold sections 57. The dye mold sections 57 are defined by vertical divider walls 61 which are of one or more selected heights based on, and having a predetermined relationship to, the tufts of the carpet tiles. The hoses 55 and fittings 56 supply colorant to the dye mold sections such that when the face portions of a carpet tile are engaged therewith, colorant is accurately and precisely supplied to the face of the carpet tile while excess colorant is prevented from overflowing from section to section.

As also illustrated in FIG. 2A, other portions of the tuft dye mold 54 which do not include dye mold sections 57 alternatively contain air bleed openings 62. The air bleed openings 62 allow registration of the tuft dye mold with the face of the carpet tile to take place more easily by allowing air to escape which would otherwise be temporarily trapped between the tuft dye mold and the impermeable backing of the carpet tile.

The carpet printing press 53 in turn further comprises a hydraulic press mechanism contained with the housing designated 63; a presser shaft 64 positioned over center portions of the printing station 40 and obedient to the hydraulic press mechanism 63; and a presser head 65 carried by lower portions of the presser shaft 64 for being urged by the presser shaft against the vacuum platen 35 and for resultingly engaging individual carpet tiles 60 with the tuft dye mold 54. One or more guide shafts 66 are positioned adjacent to the presser shaft 64 and are also engaged with the presser head 65 for evenly distributing the presser head against the vacuum platen and for resultingly providing an even distribution of pressure between the tuft dye mold 54 and an individual carpet tile 60. An indexing sensor 67, best illustrated in FIG. 3, is carried by the hydraulic press 53 and is in feedback communication with the central control and transport mechanism 20. The sensor 67 reads the indexed position of the tile carrier 21 with respect to the presser head 65 and the tuft dye mold 54 and communicates any misalignment in the respective positions of the presser head, tile carrier and tuft dye mold to the central control and transport mechanism 20 so that the central control and transport mechanism can properly adjust the position of the tile carrier 21 at the printing station 40. In the embodiment of the invention illustrated in FIG. 3, the indexing sensor 67 comprises a physical sensor which comes into contact with the trame portion 33 of the tile carrier 21, but it will be understood that any appropriate method of reading and communicating the respective positions of the appropriate parts is included within the scope of the invention and the claims.

As best shown in FIG. 8, in the same manner that the opening 34 in the frame 33 of the tile carrier 21 allows the loading press to exert force upon the vacuum platen 35 for registering tiles, the opening 34 similarly allows the presser head 65 of the printing press 53 to exert enough pressure to accomplish successful printing of the individual carpet tile while the carpet tile is being carried by the vacuum platen upon the tile carrier 21. As seen previously with respect to registration in FIG. 7 and as again illustrated in FIG. 8, the springs 41 which in the absence of other forces maintain the vacuum platen 35 in close contact with the frame 33 of the tile carrier 21, are compressed and allow the vacuum platen 35 to be moved away from the tile carrier 21 while the printing operation is taking place. When the press 53 releases its pressure, the springs 41 return the vacuum platen 35 to a position closely adjacent the frame 33. It will thus be seen that the novel construction of the tile carriers allows both the loading and printing steps to take place in a highly efficient, accurate and precise manner as a number of carpet tiles are printed one after the other with registration and repeat being controlled for uniformity of each tile.

Figure 9:
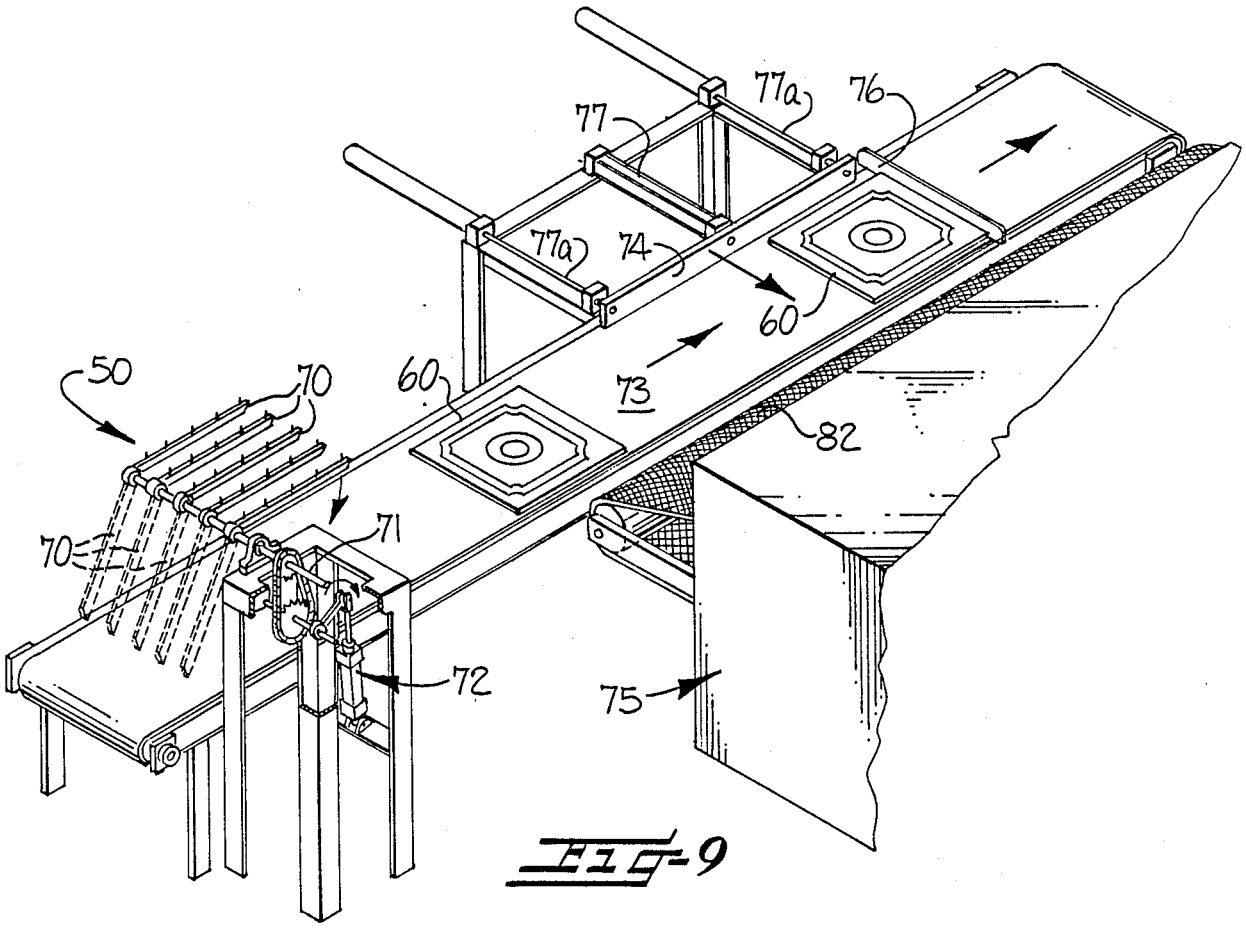
FIG. 9 is a partial perspective view of the tile unloading station and the conveyor means looking in the direction of arrow 9 in FIG. 3.

After the carpet tile 60 has been in contact with the tuft dye mold for the time period and under the pressure indicated by the correlation between the physical construction of the carpet tile, the extent of color desired and type of colorant used, the tile carrier 21 moves the carpet tile to the unloading station 50. As illustrated in FIGS. 3 and 9, the unloading station includes a plurality of unloading arms 70. The arms 70 are rotatable between a first horizontal tile receiving position which is illustrated by the solid arms 70 in FIG. 9 and a second vertical tile orienting and unloading position indicated by the arms drawn in broken lines in FIG. 9. In the embodiment illustrated in FIG. 9, the arms are maintained upon a shaft 71 and are operated by a tile unloading control means illustrated as the mechanism 72 which is obedient to the central control and transport mechanism 20. In operation, the vacuum controls 27 cut off the vacuum from the vacuum source 25 to the vacuum platen 35 so that in the absence thereof the respective tile carrier 21 positioned at the unloading station 50 releases the carpet tile 60, allowing it to drop and be received upon the arms 70 in their horizontal position. As the arms are moved by the control means 72, from the horizontal to the vertical position, they orient the printed carpet tile in a face upward position upon the adjacent conveyor 73 which receives the unloaded individual printed carpet tiles thereon and moves them to the further processing means provided by the invention.

In a preferred embodiment of the invention, the further processing provided after the carpet tiles have been unloaded includes both colorant fixing means for fixing the printed color upon the carpet tiles and drying means for receiving and drying individual carpet tiles. FIG. 1 gives an overall view of the drying and fixing means in relation to the registration, printing and unloading stations. The colorant fixing means is broadly designated at 75 and the drying means illustrated in the preferred embodiment include a vacuum drying means broadly designated at 80 and a heating drying means broadly designated at 85.

Viewed in some detail, it will first be seen from FIG. 9 that carpet tiles 60 are carried along the conveyor 73 until the tiles are adjacent the entry position 81 of the colorant fixing means 75. At this location, there are positioned means adjacent the entry position 81 and adjacent the second portions of the conveyor means for transferring individual carpet tiles from the conveyor means 73 to the colorant fixing means 75. In a preferred embodiment of the invention, these transfer means comprise an arm 74, horizontally oriented and running generally parallel to the direction of travel of the conveyor 73. Adjacent to and perpendicular to the arm 74 is a tile stop member 76 extending across the conveyor 73 for positioning tiles adjacent the entry position 81 while allowing the conveyor 73 to keep moving. In this manner, one or more tiles may be positioned adjacent the entry position 81 of the colorant fixing means 75 and in the preferred embodiment illustrated in the drawings, two of such tiles are positioned adjacent the arm 74 before they are transferred into the colorant fixing means 75. The arm 74 is moved forwardly by a piston and cylinder 77 and is guided by guide rods **77*a*. The cylinder and piston 77 act in response to the number of tiles positioned in front of the arm 74 and against the stop member 76 and in the preferred embodiment urges the arm 74 against two of such tiles 60 and pushes them into the entry position 81 to the colorant fixing means 75** to be described hereinafter.

In the broadest sense, the colorant fixing means 75 includes means for fixing colorant on the face portions of individual carpet tiles while concurrently avoiding undesirable treatment of the backed portions of individual carpet tiles. As described earlier herein, the backed portions of the carpet tiles generally comprise impermeable layers formed of materials different from the materials which form the face portions of the carpet tiles. Accordingly, fixing treatments such as steaming which are desirable for the face portions and which have no adverse effects on other types of carpet backing, can undesirably affect the backed portions of carpet tiles.

Figure 10:
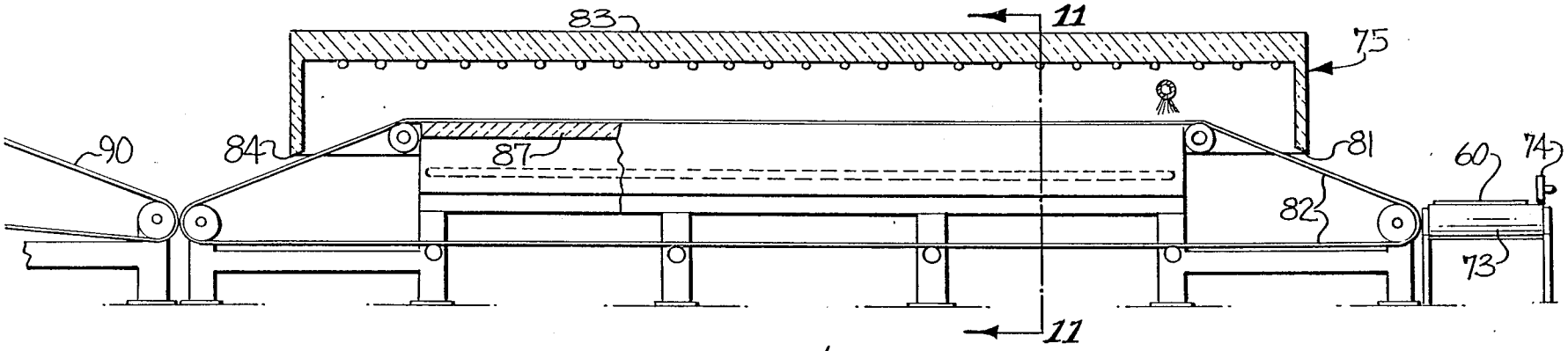
FIG. 10 is a longitudinal sectional view of the colorant fixing means taken along lines 10—10 of FIG. 1.
Figure 11:
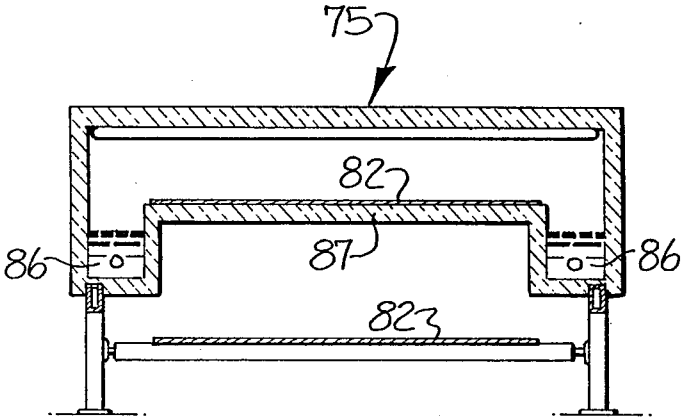
FIG. 11 is a transverse sectional view of the colorant fixing means taken along lines 11—11 of FIG. 10.

In a broad sense the colorant fixing means of the present invention comprises a carpet tile steamer, but the steamer of the present invention includes novel features especially suitable for the treatment of backed carpet tiles. The main features of a preferred embodiment of the steamer 75 are best illustrated in FIGS. 10 and 11. The longitudinal view of FIG. 10 shows the tile entry position 81, portions of which are adjacent the second portions of the conveyor 73. The steamer includes a housing 83 with the entry position 81 and the exit position 84 at respective opposite ends thereof. A conveyor 82 travels from the exterior of the housing 83 into the entry position 81, horizontally through the interior of the housing and outwardly from the exit position 84 for carrying individual carpet tiles oriented in the face upward position in which they were positioned by the unloading station into, through and out of the carpet tile steamer 75.

Steam sources 86 are positioned within the housing and are spaced apart from the conveyor for providing an indirect supply of steam and steam heat to the face portions of individual carpet tiles in order to fix colorant thereon. These steam sources are best seen in FIG.

11, and in order to treat the face portions of the carpet tiles while avoiding undesirable treatment of the backed portions, the steam sources 86 are positioned below of and generally alongside the conveyor 82. Additionally, insulation 87 is positioned underneath the portions of the conveyor 82 which run within the housing 83 and protects the backed portions of individual carpet tiles from excessive steam and steam heat. As illustrated in FIGS. 10 and 11, as the carpet tiles 60 move from the conveyor 73 onto the belt 82 and into the entry position 81 of the steamer 75, they are carried above the insulation 87. The steam sources 86 are positioned alongside of and below the level of the conveyor 82 and in order for steam from the steam sources 86 to reach the carpet tiles, it must travel upwardly and laterally within the housing 83. With the steam sources so positioned, steam cannot directly reach the bottom portions of the carpet tile which rest against the conveyor 82 as it travels over the insulation 87.

After exiting the steamer 75, and as illustrated in the overall view of FIG. 1, the carpet tiles next move to one or more drying means which in a preferred embodiment of the invention comprise both vacuum drying means 80 and a heater 85. The vacuum drying means 80 are positioned adjacent the exit position 84 of the steamer 75 and remove moisture from individual carpet tiles by applying a vacuum suction thereto. The heater 85 is positioned adjacent the vacuum drying means 80 and receives and dries individual carpet tiles.

Figure 12:
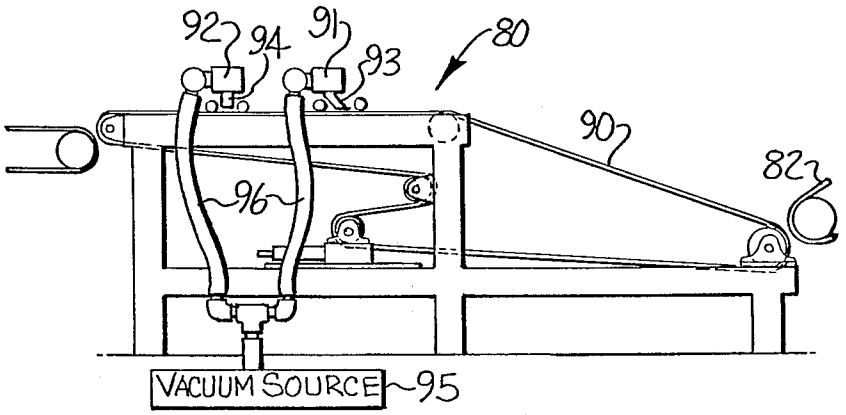
FIG. 12 is a side elevational view of a portion of the drying means.

As illustrated in the side elevational view of FIG. 12, the vacuum drying means 80 includes tile transport means shown as the vacuum conveyor 90. The dryer conveyor 90 is positioned directly adjacent the steamer conveyor 82 so that the steamer conveyor 82 will pass carpet tiles exiting the steamer 75 directly onto the vacuum conveyor 90. The conveyor 90 then moves individual carpet tiles continuously towards and through the vacuum drying means 80.

In the embodiment illustrated, the vacuum drying means 80 further comprises first and second vacuum manifolds designated at 91 and 92 respectively. The manifolds 91 and 92 are positioned in parallel relationship adjacent one another above the vacuum conveyor 90 perpendicular to the conveyor's direction of travel and are connected to a vacuum source for removing moisture from individual carpet tiles. A first vacuum nozzle 93 is positioned in communication with the first vacuum manifold 91 immediately therebeneath in a closely spaced relationship to the vacuum conveyor 90. The first vacuum nozzle 93 has a width at least that of the individual carpet tiles to be passed thereunder and is inclined from the first manifold 91 in a direction opposite to the direction of travel of the tile transport means. It has been discovered in accordance with the present invention that the inclined pickup nozzle more efficiently removes moisture from individual carpet tile 60 during their respective movement thereunder. A second vacuum nozzle 94 is in communication with the second vacuum manifold 92 and is likewise positioned immediately therebeneath and in closely spaced relationship to the vacuum conveyor 90. The second vacuum nozzle 94 also has a width at least that of the individual carpet tiles to be passed thereunder and is disposed generally perpendicularly to the direction of travel of the vacuum conveyor 90 and removes additional moisture from individual carpet tiles that have passed under the first vacuum nozzle 93. As illustrated in FIG. 12, a vacuum source 95 is provided to supply a vacuum suction to the manifolds 91 and 92 through a pair of hoses 96.

Figure 13:
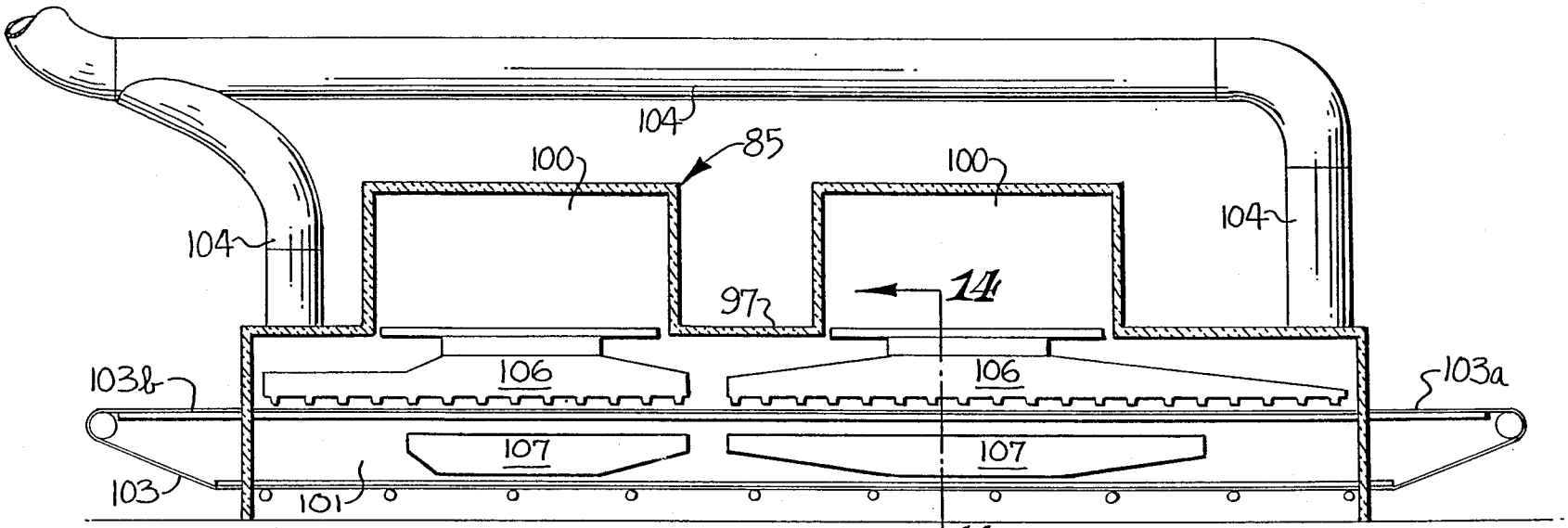
FIG. 13 is a longitudinal sectional view of another portion of the drying means taken along lines 13—13 of FIG. 1.
Figure 14:
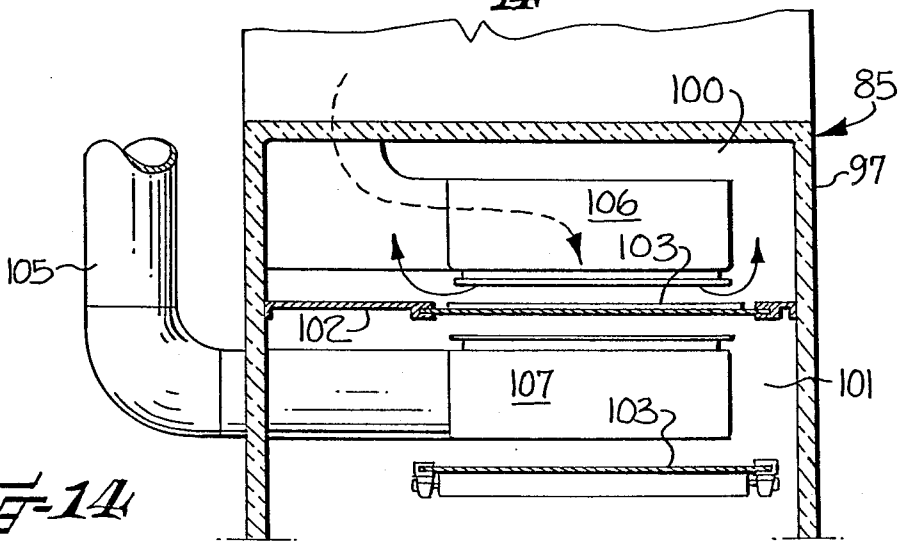
FIG. 14 is a transverse sectional view taken along lines 14—14 of FIG. 13.

In the embodiment of the invention illustrated in the drawings, the drying means further comprises a heater 85 positioned opposite the vacuum drying means from the colorant fixing means 75 for receiving individual carpet tiles therein and heating them to dryness. As shown in more detail in FIGS. 13 and 14, the dryer comprises a housing 97 which includes respective upper and lower chambers 100 and 101 separated by a heat seal barrier 102. A drying conveyor 103 is positioned within the upper chamber 100 and directly overlies the heat seal barrier 102 and the lower chamber 101. The conveyor 103 also has portions 103A and 103B, respectively, extending outwardly from the opposite ends of the dryer housing 97 for carrying individual carpet tiles oriented in face upward position into, through and out of the dryer housing 97.

Means are provided in communication with the upper chamber 100 for circulating heated air therethrough. In the illustrated embodiment of the invention, the means are shown as the ducts 104 traveling above and into the housing 97. As set forth with regard to the colorant fixing means, drying treatments which may be desirable for the face portions of carpet tiles may be undesirable for their respective backed portions. Accordingly, means are provided in communication with the lower chamber 101 for circulating ambient air therethrough and are shown as the ducts 105 in FIG. 14. In operation, the heated air circulated from the ducts 104 through the upper chamber 100 drys the face portions of individual carpet tiles while the ambient air circulating from the ducts 105 through the lower chamber 101 helps prevent the backed portions of individual carpet tiles from being undesirably affected by the heated air.

Further to the illustrated embodiment of the invention, circulating hoods indicated at 106 are positioned above the conveyor 103 for helping to direct heated air against the face portions of carpet tiles while similar circulating hoods 107 help circulate ambient air in the lower chamber 101 of the dryer 85 to help accomplish the intended moderating effects of the circulation of ambient air.

In overall operation single tiles are first loaded onto the tile alignment receptacle 52 which ensures that all tiles loaded therein are identically aligned. By moving the tile alignment receptacle 52 into the tile registration position, properly places a carpet tile for registration with the respective vacuum platen 35 then positioned at the registration station 30. After being loaded onto the tile carrier, the turreting mechanism 24 of the central control and transport mechanism 20 rotates and moves the tile carrier and tile to the printing station 40. When the indexing sensor 67 indicates that the tile carrier and hence the tile are properly aligned, the carpet printing press 53 engages the carpet tile with the tuft dye mold 54. The repetitive accuracy and precision of the entire mechanism, the construction of the tuft dye mold, the control of the colorant and the correlation of the amount of colorant, printing time and printing pressure all ensure a highly reproduceable printing technique. After the printing step, the turreting mechanism 24 moves the tile carrier and tile to the unloading and orientation station 50. At this position, the vacuum controls 27 release the vacuum upon the vacuum platen 35 so that the carpet tile 60 drops onto the unloading arms 70 which pivot and thus unload the printed carpet tile in a face upward position onto the conveyor 73. The continuous sequential successive operation of the central control and transport mechanism in conjunction with the registration printing and unloading stations results in the ability to accurately and precisely reproduce one or more printed patterns upon large numbers of individual carpet tiles.

From the conveyor 73 the individual carpet tiles are moved into the steamer 75 to fix the colorant thereon. Upon exiting the steamer, the tiles are subjected to vacuum drying at the vacuum manifolds 91 and 92 and then drying in the dryer 85. As discussed earlier herein, both the steamer and the dryer are specifically designed to protect the tile's resilient backing material while fixing and drying the materials which form the face portion.

The entire operation results in an assured ability to reproduce given patterns in an efficient, accurate and precise manner on large numbers of individual carpet tiles.

The foregoing embodiment are to be considered illustrative, rather than restrictive of the invention, and those modifications which come within the meaning and range of equivalence of the claims are to be included therein.

That which is claimed is:

1. An apparatus for accurate, precise and successive registration, indexing and printing of individual pre-cut backed carpet tiles, said apparatus comprising:

a central control and transport mechanism for controlling and accomplishing the movement, registration, indexing, printing and unloading of individual carpet tiles and including a motorized turret having a plurality of arms thereon for bearing carpet tiles and for movably and sequentially presenting carpet tiles to each of said processing stations, and means for controlling the sequential movement and presentation of said arms;

a plurality of tile processing stations adjacent one another and surrounding said central control and transport mechanism;

a plurality of tile carriers movably carried by said arms, each of said carriers being sequentially movable to each of said respective processing stations for sequentially carrying individual carpet tiles to one or more of said processing stations and each of said tile carriers further comprising a platen support maintained upon each of said arms, and a vacuum platen positioned immediately beneath said platen support for exerting a vacuum pull against individual carpet tiles to be carried by said tile carrier;

at least one of said processing stations comprising a tile registration station;

tile registration means, portions of which overlie said tile registration station for accurate and precise registration of individual carpet tiles with one of said tile carriers;

at least one of said processing stations comprising a printing station;

tile printing means positioned at said printing station for receiving, and printing individual carpet tiles carried by said tile carriers;

at least one of said processing stations comprising a tile unloading station; and tile unloading and orientation means positioned at said unloading station for unloading individual carpet tiles from said tile carriers and for properly orienting individual carpet tiles for further transport and processing.

2. An apparatus according to claim 1 wherein said tile registration means comprises:

a loading press for causing said vacuum platen to engage individual carpet tiles to be registered;

an alignment assembly positioned opposite to and cooperatively operable with said loading press for loading and positioning individual carpet tiles adjacent said vacuum platen; and vacuum control means operable in response to said central control mechanism and concurrently with said press and said loading assembly for causing said vacuum platen to engage and maintain individual carpet tiles thereupon.

3. An apparatus according to claim 1 wherein said printing station comprises:

a carpet printing press for causing pressure to be exerted on the backed portions of individual carpet tiles;

a tuft dye mold positioned opposite said printing press and concurrently engageable with the face portions of individual carpet tiles;

colorant supply means for supplying colorant to said tuft dye mold; and print regulating means for correlating the duration, pressure and amount of colorant supplied during the engagement of individual carpet tiles with said press and said tuft dye mold.

4. An apparatus according to claim 1 wherein said unloading station comprises:

a plurality of unloading arms rotatable between a first horizontal tile receiving position and a second vertical tile orienting and unloading position, for receiving individual carpet tiles from the respective tile carrier positioned at said unloading station upon said arms, whereby the movement of said arms from said first position to said second position unloads and properly orients individual carpet tiles for further processing;

tile unloading control means obedient to said central control and transport mechanism for directing said respective tile carriers to release individual carpet tiles at said unloading station onto said unloading arms; and conveyor means positioned adjacent said unloading arms for receiving thereon unloaded oriented individual carpet tiles and for moving said individual carpet tiles to further processing means.

5. An apparatus for accurate, precise and successive registration, indexing and printing of individual pre-cut backed carpet tiles said apparatus comprising:

a central control and transport mechanism for controlling and accomplishing the movement, registration, indexing, printing and unloading of individual carpet tiles; said central control and transport mechanism comprising;

a motorized turret, three arms positioned upon said turret, and means for controlling the sequential movement of said arms;

three tile processing stations adjacent one another and surrounding said central control and transport mechanism;

three tile carriers movably carried by said arms, each of said carriers being sequentially movable to each of said respective processing stations for sequentially carrying individual carpet tiles to one or more of said processing stations, each of said tile carriers comprising:

a platen support maintained upon each of said arms, and a vacuum platen positioned immediately beneath said platen support for exerting a vacuum pull against individual carpet tiles to be carried by said tile carrier so that individual carpet tiles are maintained upon said tile carriers while being sequentially carried to and positioned at each of said respective processing stations;

a tile registration station;

a loading press overlying portions of said tile registration station for causing one of said vacuum platens to engage individual carpet tiles to be registered;

an alignment assembly positioned opposite to and cooperatively operable with said loading press for loading and positioning individual carpet tiles adjacent said vacuum platen;

vacuum control means operable in response to said central control mechanism and concurrently with said loading press and said loading assembly for causing said vacuum platen to engage and maintain individual carpet tiles thereupon;

a printing station;

a carpet printing press overlying said printing station for causing pressure to be exerted on the backed portions of individual carpet tiles;

a tuft dye mold positioned opposite said printing press and concurrently engageable with the face portions of individual carpet tiles;

colorant supply means for supplying colorant to said tuft dye mold;

print regulating means for correlating the duration, pressure and amount of colorant supplied during the engagement of individual carpet tiles with said press and said tuft dye mold;

a tile unloading station;

a plurality of unloading arms positioned at said unloading station and rotatable between a first horizontal tile receiving position and a second vertical tile orienting and unloading position, for receiving individual carpet tiles from the respective tile carrier positioned at said unloading station upon said arms, whereby the movement of said arms from said first position to second position unloads and properly orients individual carpet tiles for further processing;

tile unloading control means obedient to said central control and transport mechanism for directing said respective tile carriers to release individual carpet tiles at said unloading station onto said unloading arms; and conveyor means positioned adjacent said unloading arms for receiving thereon unloaded oriented individual carpet tiles and for moving said individual carpet tiles to further processing means.

6. An appartus according to claim 5 in which said central control and transport mechanism further comprises:

a central vacuum source for supplying vacuum pull to each of said vacuum platens;

a plurality of individual vacuum controls in communication with said central vacuum source for initiating, regulating and terminating the vacuum pull exerted by each of said vacuum platens; and a plurality of individual hoses in communication with said central vacuum source and in respective communication with said individual vacuum controls and with said respective vacuum platens for supplying the vacuum pull provided by said source and regulated by said controls to said respective vacuum platens.

7. An apparatus according to claim 5 in which each of said tile carriers further comprises:

a generally rectangular frame portion carried in a substantially horizontal orientation by one of said arms and having a horizontally oriented centralized opening therethrough for allowing mechanical access to said vacuum platen independent of said frame; and a plurality of elastic members positioned on said frame at spaced apart locations adjacent said centralized opening and engaging said frame and said vacuum platen for urging said vacuum platen against said frame and for maintaining said vacuum platen in a substantially horizontal orientation closely adjacent said frame in the absence of other forces acting thereon while allowing said platen to be shifted partially away from said frame by the respective actions of said loading press, said printing press or said print regulating means.

8. An apparatus according to claim 7 in which said elastic members comprise four springs positioned adjacent the respective four corners of said generally rectangular frame and adjacent said centralized opening therein.

9. An apparatus according to claim 5 wherein said loading press further comprises:

a loading press support, first portions of which are positioned adjacent said tile registration station and second portions of which overlie said tile registration station;

a loading piston carried by said second portions of said support; and a pressure plate engaged beneath and obedient to said loading piston and directly overlying said tile registration station for being urged by said loading piston against portions of one of said respective vacuum platens positioned at said tile registration station whereby said loading press may urge said respective vacuum platen against individual carpet tiles to be registered therewith.

10. An apparatus according to claim 5 wherein said alignment assembly further comprises a tile alignment receptacle movable between respective first and second positions at said tile registration station, said first position being laterally offset from said loading press and said second position underlying said loading press, for allowing initial loading and aligning of individual carpet tiles on said receptacle at said first position and for then being moved to said second position whereby individual carpet tiles loaded and aligned on said receptacle at said first position are appropriately aligned for registration with said tile carrier when said receptacle is moved to said second position.

11. An apparatus according to claim 5 wherein said tuft dye mold is of the same shape and size as the individual carpet tiles to be printed and portions of which include a plurality of dye mold sections defined by vertical divider walls of one or more selected heights having a predetermined relationship to the tufts of the carpet tiles.

12. An apparatus according to claim 11 wherein portions of said tuft dye mold which do not include dye mold sections contain air bleed openings whereby air may more easily escape from between said tuft dye mold and individual carpet tiles brought into engagement therewith thereby providing a more accurate and precise registration of said tuft dye mold with individual carpet tiles.

13. An apparatus according to claim 5 wherein said carpet printing press comprises:

a hydraulic press mechanism;

a presser shaft positioned over center portions of said printing station and obedient to said hydraulic press mechanism;

a presser head carried by lower portions of said presser shaft for being urged by said shaft against said vacuum platen and for resultingly pressing individual carpet tiles against said tuft dye mold;

guide shafts positioned adjacent said presser shaft and engaged with said presser head for evenly distributing said presser head against said vacuum platen and for resultingly providing an even distribution of pressure between said tuft dye mold and individual carpet tiles brought into engagement therewith; and an indexing sensor carried by said hydraulic press mechanism and in feedback communication with said central control and transport mechanism for reading the indexed position of individual carpet tiles with respect to said presser head and said tuft dye mold and for communicating any misalignment in said respective positions to said central control and transport mechanism whereby said central control and transport mechanism may adjust the position of said tile carrier at said printing station and thereby properly indexing individual carpet tiles for printing.

14. An apparatus for accurate, precise and successive registration, indexing and printing of individual precut backed carpet tiles, said apparatus comprising:

a central rotating turret having a plurality of arms extending radially therefrom for controlling and accomplishing the movement, registration, indexing, printing and unloading of individual carpet tiles;

a plurality of tile processing stations adjacent one another and surrounding said central rotating turret;

means movably carried by each of said radially extending arms for lifting an individual carpet tile from any one of said processing stations and for carrying the lifted carpet tile to any other of said processing stations and for positioning the individual carpet tile for processing at said other one of said processing station while maintaining the backed carpet tile in a generally horizontal orientation with the tufted side facing downwardly and the backed side facing upwardly;

at least one of said processing stations comprising a carpet tile registration station;

at least one of said processing stations comprising a printing station having an upwardly facing tuft dye mold and a downwardly facing carpet tile press; and at least one of said processing stations comprising a tile unloading station.

15. An apparatus according to claim 14 wherein each of said means for lifting, carrying and positioning individual carpet tiles comprises a platen support maintained upon each of said arms and a vacuum platen positioned immediately beneath said platen support for exerting a vacuum pull against individual carpet tiles to be carried by said tile carrier.

* * * * *